US007690216B2

(12) United States Patent
Chang et al.

(10) Patent No.: US 7,690,216 B2
(45) Date of Patent: Apr. 6, 2010

(54) OIL SEPARATOR FOR AIR CONDITIONERS

(75) Inventors: Se Dong Chang, Gwangmyeong-si (KR); Yoon Been Lee, Seoul (KR); Baik Young Chung, Incheon-si (KR)

(73) Assignee: LG Electronics Inc., Seoul (KR)

( * ) Notice: Subject to any disclaimer, the term of this patent is extended or adjusted under 35 U.S.C. 154(b) by 939 days.

(21) Appl. No.: 11/285,112

(22) Filed: Nov. 23, 2005

(65) Prior Publication Data

US 2006/0107687 A1 May 25, 2006

(30) Foreign Application Priority Data

Nov. 25, 2004 (KR) ..... 10-2004-0097545

(51) Int. Cl.
*F25B 43/02* (2006.01)

(52) U.S. Cl. ..... 62/470

(58) Field of Classification Search ..... 62/407, 62/84, 472, 473; 210/167.02
See application file for complete search history.

(56) References Cited

U.S. PATENT DOCUMENTS 5,170,640 A * 12/1992 Heitmann et al. ..... 62/470
5,265,432 A 11/1993 Luepke et al.
5,347,817 A * 9/1994 Kim ..... 62/471
6,279,556 B1 * 8/2001 Busen et al. ..... 123/572
6,510,698 B2 * 1/2003 Kasai et al. ..... 62/77
6,736,884 B2 * 5/2004 Virgilio ..... 96/189

FOREIGN PATENT DOCUMENTS

| | | |
|---|---|---|
| CN | 1165554 A | 11/1997 |
| JP | 5-312418 | 11/1993 |
| JP | 06-018127 | 1/1994 |
| JP | 06-235572 | 8/1994 |

* cited by examiner

*Primary Examiner*—Melvin Jones
(74) *Attorney, Agent, or Firm*—Birch, Stewart, Kolasch & Birch, LLP

(57) ABSTRACT

Disclosed herein is an oil separator for air conditioners that is capable of separating oil from refrigerant. The oil separator comprises a shell having a cylindrical space defined therein, a refrigerant introduction pipe for introducing refrigerant into the shell, a refrigerant discharge pipe for discharging the refrigerant out of the shell, and oil-drop growth accelerating member for accelerating growth of oil drops contained in the refrigerant flowing in the shell.

18 Claims, 7 Drawing Sheets

OIL SEPARATOR FOR AIR CONDITIONERS

This application claims the benefit of Korean Patent Application No. P2004-97545, filed on Nov. 25, 2004, which is hereby incorporated by reference as if fully set forth herein.

BACKGROUND OF THE INVENTION

1. Field of the Invention

The present invention relates to an air conditioner, and more particularly, to an oil separator for air conditioners that is capable of separating oil from refrigerant.

2. Discussion of the Related Art

Generally, an air conditioner is an apparatus used to cool or heat the interiors of houses, restaurants or office buildings. FIG. 8 shows a schematic view of an air conditioner, including an expansion valve 10, an indoor heat exchanger 20, a compressor 30, an outdoor heat exchanger 40, an oil separator 60, and an air conditioner 100. The air conditioner comprises an indoor unit and an outdoor unit. The indoor and outdoor units are connected to each other via a refrigerant flow channel, through which refrigerant flows between the indoor and outdoor units. Also, the outdoor unit has a compressor for compressing the refrigerant.

While flowing between the indoor and outdoor units through the refrigerant flow channel, the refrigerant absorbs or emits heat, based on phase change of the refrigerant, to control the temperature of indoor air. When the air conditioner is operated in cooling mode, for example, the refrigerant is evaporated in the indoor unit to absorb heat from the indoor air. Also, the refrigerant is condensed in the outdoor unit to emit heat.

Meanwhile, the compressor is one of moving parts of the air conditioner. For this reason, a large amount of oil is injected into the compressor to prevent wear of parts of the compressor due to friction between the parts of the compressor, partially cool heat generated when the refrigerant is compressed in the compressor, disperse fatigue of metal parts of the compressor, and prevent leakage of the compressed refrigerant through formation of oil film at a sealing line of the compressor.

When the refrigerant is compressed in the compressor, however, the oil injected into the compressor is mixed with the refrigerant. As a result, the compressed refrigerant is discharged out of the compressor together with the oil injected into the compressor. If refrigerant containing oil flows through the refrigerant flow channel, the oil may be accumulated in some parts of the refrigerant flow channel, and therefore, the refrigerant cannot smoothly flow. Furthermore, the amount of oil in the compressor is decreased, and therefore, performance of the compressor is deteriorated.

SUMMARY OF THE INVENTION

Accordingly, the present invention is directed to an oil separator for air conditioners that substantially obviates one or more problems due to limitations and disadvantages of the related art.

An object of the present invention is to provide an oil separator for air conditioners that is capable of separating oil from refrigerant.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an oil separator for air conditioners comprises: a shell having a cylindrical space defined therein; a refrigerant introduction pipe for introducing refrigerant into the shell; a refrigerant discharge pipe for discharging the refrigerant out of the shell; and oil-drop growth accelerating member for accelerating growth of oil drops contained in the refrigerant flowing in the shell.

Preferably, the oil-drop growth accelerating member accelerates growth of the oil drops by creating vortex flow in the refrigerant introduced into the shell. The oil-drop growth accelerating member is a bar-shaped member mounted in the shell. In a preferred embodiment, the oil-drop growth accelerating member has a circular section. In another preferred embodiment, the oil-drop growth accelerating member is porous.

Preferably, the oil-drop growth accelerating member is disposed in the longitudinal direction of the shell. The oil-drop growth accelerating member is spaced a predetermined distance from an inner circumferential surface of the shell. The oil separator further comprises: heater for heating the shell.

Also preferably, the oil separator further comprises: a temperature sensor for detecting the surface temperature of the shell. The heater heats the shell when the air conditioner is in standby mode. More preferably, the heater heats the shell such that the surface of the shell is maintained at a temperature of 40 to 50° C.

In another aspect of the present invention, an oil separator for air conditioners comprises: a shell having a cylindrical space defined therein; a refrigerant introduction pipe for introducing refrigerant into the shell; a refrigerant discharge pipe for discharging the refrigerant out of the shell; and oil separating member for separating oil drops from the refrigerant by inducing collision of the oil drops contained in the refrigerant flowing in the shell.

Preferably, the oil separating member changes flow speed and flow direction of the refrigerant flowing in the shell to induce collision of the oil drops such that the size of the oil drops is increased. The oil separating member is mounted in the shell in the longitudinal direction of the shell. The oil separating member is spaced a predetermined distance from an inner circumferential surface of the shell.

In a preferred embodiment, the oil separating member has a circular section. In another preferred embodiment, the oil separating member is porous. Preferably, the oil separator further comprises: heater for heating the shell. Also preferably, the oil separator further comprises: a temperature sensor for detecting the surface temperature of the shell. The heater heats the shell when the air conditioner is in standby mode. More preferably, the heater heats the shell such that the surface of the shell is maintained at a temperature of 40 to 50° C.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
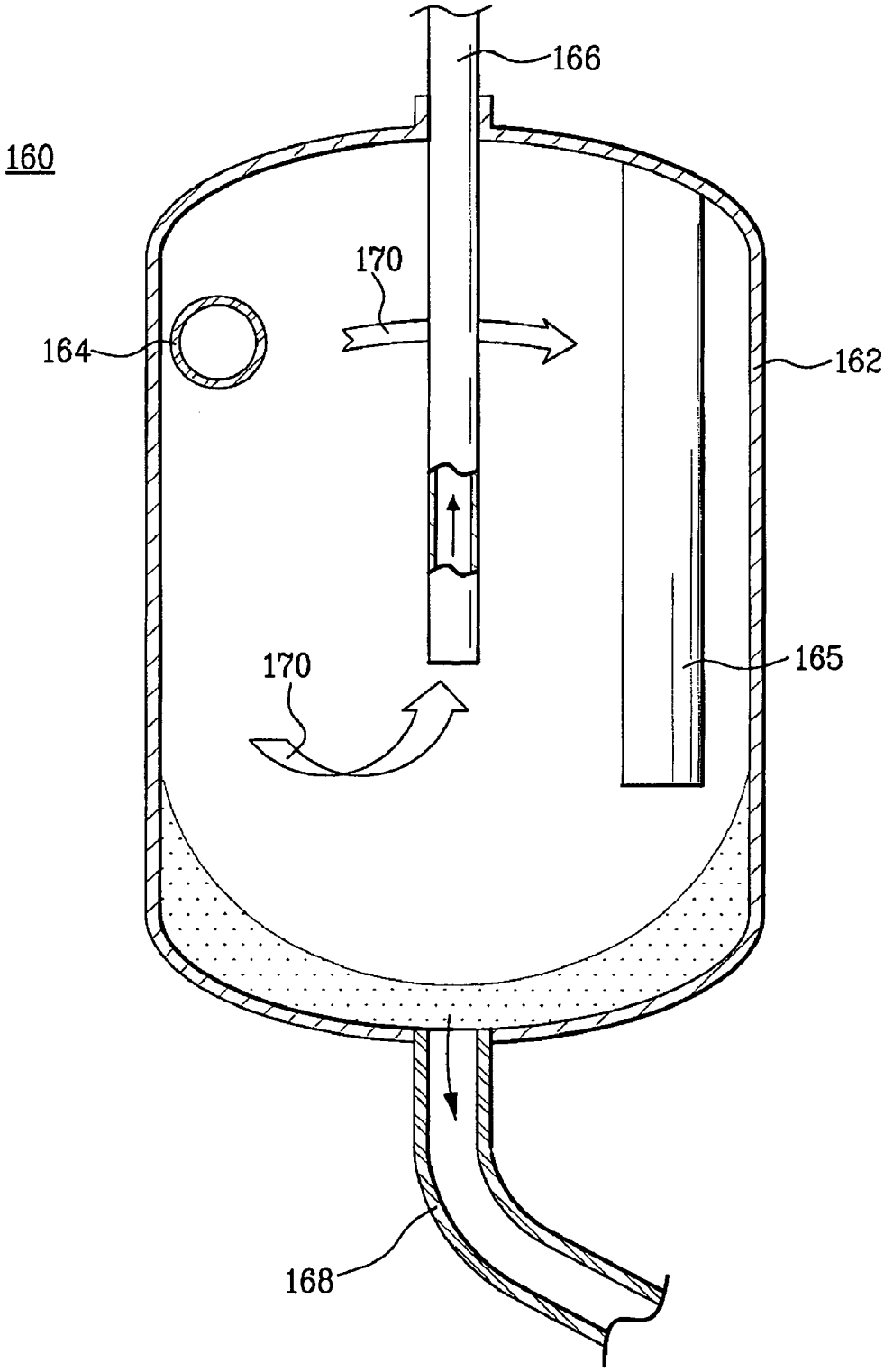
FIG. 1 is a longitudinal sectional view illustrating an oil separator for air conditioners according to a first preferred embodiment of the present invention.

An oil separator 160 for air conditioners according to a first preferred embodiment of the present invention will be described hereinafter in detail with reference to FIGS. 1 to 5. Referring first to FIG. 1, the oil separator 160 comprises a shell 162 mounted at the outlet port of a compressor (not shown). The shell 162 forms the outer appearance of the oil separator 160. Preferably, the shell 162 has a cylindrical space defined therein.

Figure 2:
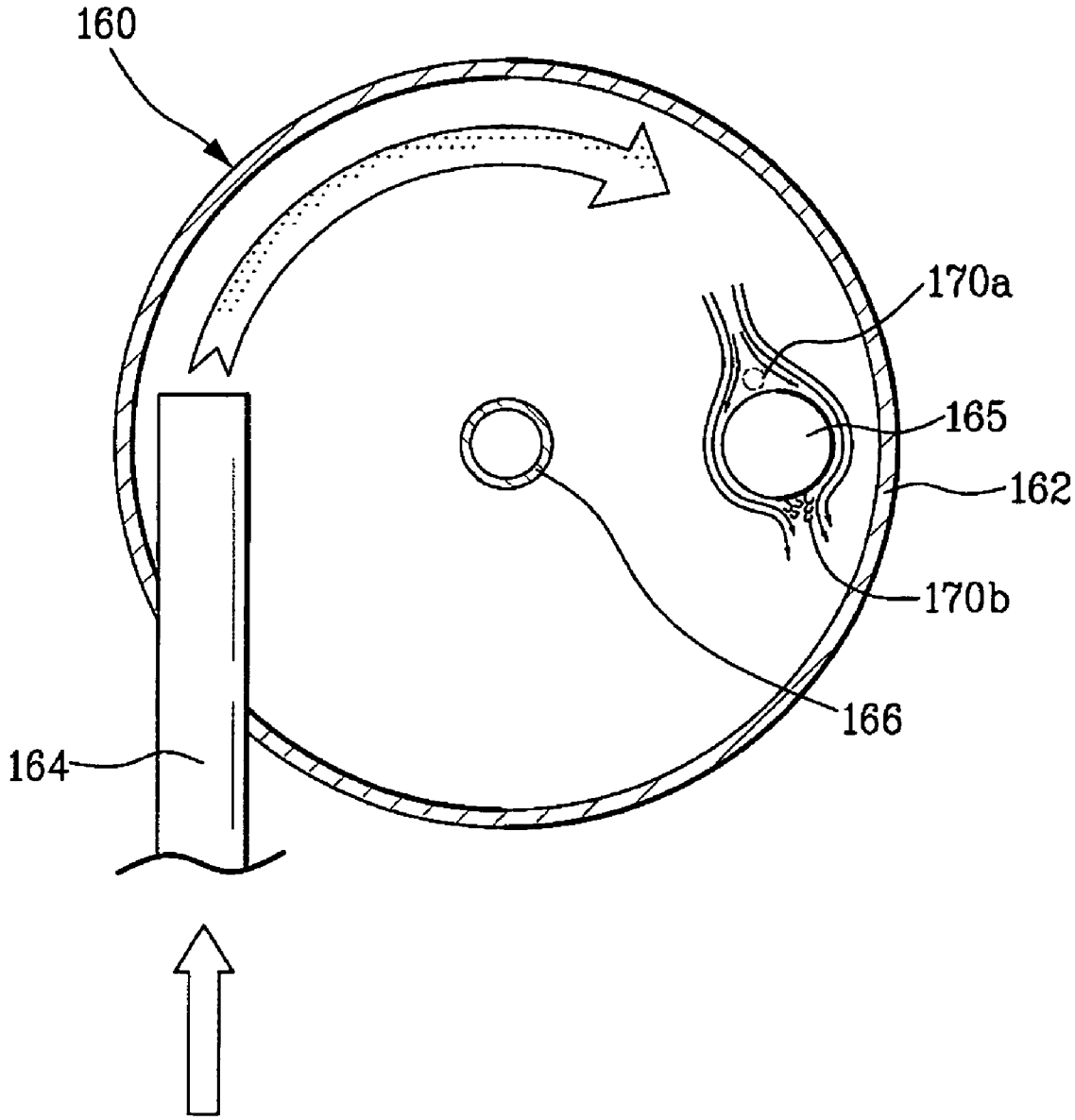
FIG. 2 is a cross-sectional view of the oil separator for air conditioners according to the first preferred embodiment of the present invention.

In the shell 162 is disposed a refrigerant introduction pipe 164, which is connected to the outlet port of the compressor. Refrigerant 170 is introduced into the shell 162 from the compressor through the refrigerant introduction pipe 164. Preferably, the refrigerant introduction pipe 164 is mounted at the inner circumferential surface of the shell 162 in the tangential direction, as shown in FIG. 2, such that the refrigerant 170 introduced into the shell 162 can flow along the inner circumferential surface of the shell 162.

As shown in FIG. 1, a refrigerant discharge pipe 166 is vertically disposed in the center part of the shell 162 for allowing the refrigerant 170, which is in a gaseous state, to be discharged out of the shell 162 therethrough. Preferably, the refrigerant discharge pipe 166 extends a predetermined length through the upper end of the shell 162 such that one end of the refrigerant discharge pipe 166 is disposed at the outside of the shell 162 and the other end of the refrigerant discharge pipe 166 is disposed at the inside of the shell 162. In addition, an oil collection pipe 168 for collecting oil is connected to the lower end of the shell 162.

In the shell 162 is also disposed oil-drop growth accelerating member for accelerating growth of fine oil drops 171 (see FIG. 3) contained in the refrigerant 170 introduced into the shell 162. The oil-drop growth accelerating member serves to increase the size and mass of the fine oil drops 171 contained in the refrigerant 170 introduced into the shell 162. Specifically, the size and mass of the fine oil drops 171 contained in the refrigerant 170 are grown by the oil-drop growth accelerating member such that the mass of the oil drops 171 is greater than that of the refrigerant. When the mass of the oil drops 171 is greater than that of the refrigerant, the oil drops 171 are separated from the refrigerant 170 by the difference in mass between the oil drops 171 and the refrigerant 170.

The growth in size and mass of the oil drops 171 is accomplished through combination of the oil drops 171 by collision of the oil drops 171 contained in the refrigerant 170. The collision of the oil drops 171 occurs in proportion to change in flow speed and flow direction of the refrigerant 170 containing the oil drops 171. For example, the oil drops 171 collide with one another when the refrigerant 170 flows in the shape of vortex or the refrigerant 170 is stagnated.

The oil-drop growth accelerating member is a kind of oil separating member for separating the oil drops 171 from the refrigerant 170 by inducing collision of the oil drops 171. The oil separating member changes flow speed and flow direction of the refrigerant 170 to induce collision of the oil drops 171. Flow speed and flow direction of the refrigerant 170 are changed by means of an oil separating bar 165 mounted in the shell 162.

Preferably, the oil separating bar 165 is disposed in the longitudinal direction of the shell 162 while being spaced a predetermined distance from the inner circumferential surface of the shell 162, along which the refrigerant 170 introduced into the shell 162 though the refrigerant introduction pipe 164 flows. Also preferably, the oil separating bar 165 has a circular section. However, the shape of the oil separating bar 165 is not limited so long as the flow speed and the flow direction of the refrigerant 170 introduced into the shell 162 are appropriately changed by the oil separating bar 165.

As shown in FIG. 2, the refrigerant 170 introduced into the shell 162 through the refrigerant introduction pipe 164 flows, in the shape of a circle along the inner circumferential surface of the shell 162, to the oil separating bar 165. At this time, the refrigerant 170 is diverged in front of the oil separating bar 165. As a result, a stagnation point 170*a* is created in front of the oil separating bar 165 where flow speed of the refrigerant 170 is abruptly decreased. The diverged components of the refrigerant 170 flow laterally along the outer circumferential surface of the oil separating bar 165. As a result, the flow direction of the refrigerant 170 is changed, and therefore, vortex flow 170*b* is created in the rear of the oil separating bar 165.

Meanwhile, the oil drops 171 contained in the refrigerant 170 have mass greater than that of the refrigerant 170. Consequently, when the flow speed of the refrigerant 170 is greatly changed or the flow direction of the refrigerant 170 is greatly changed, the oil drops 171 collide with one another more frequently due to inertia. As a result, the oil drops 171 are grown, i.e., the size and the mass of the oil drops 171 are increased.

Figure 3:
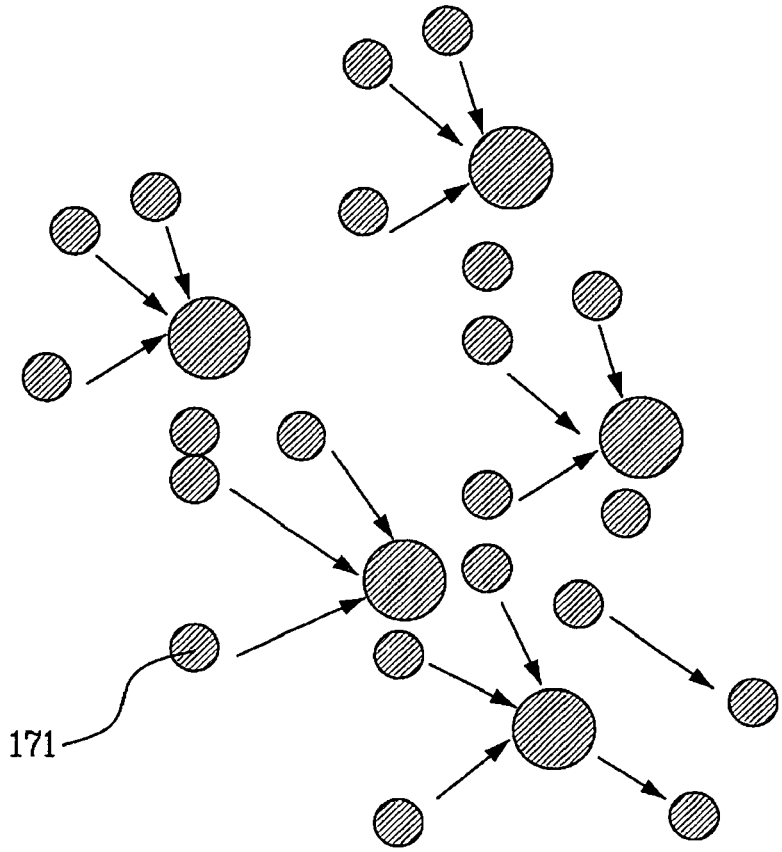
FIG. 3 is a view illustrating combination of oil drops by collision in the oil separator for air conditioners according to the first preferred embodiment of the present invention.

The flow speed of the refrigerant 170 is greatly decreased at the stagnation point 170*a*. Consequently, the oil drops 171 contained in the refrigerant 170 collide with one another, and are thus combined with one another, as shown in FIG. 3. The oil drops 171 also collide with one another at the rear of the oil separating bar 165 where the vortex flow 170*b* is created, and therefore, the oil drops 171 are grown, i.e., the size and the mass of the oil drops 171 are increased.

Whenever the refrigerant 170 flows along the inner circumferential surface of the shell 162 in a cycle, the refrigerant 170 reaches the oil separating bar 165. Consequently, the oil drops 171 are repetitively grown. After the oil drops 171 are sufficiently grown, the oil drops 171 are separated outward from the refrigerant 170 flowing along the inner circumferential surface of the shell 162 by inertia, and then adhere to the inner circumferential surface of the shell 162.

Figure 4:
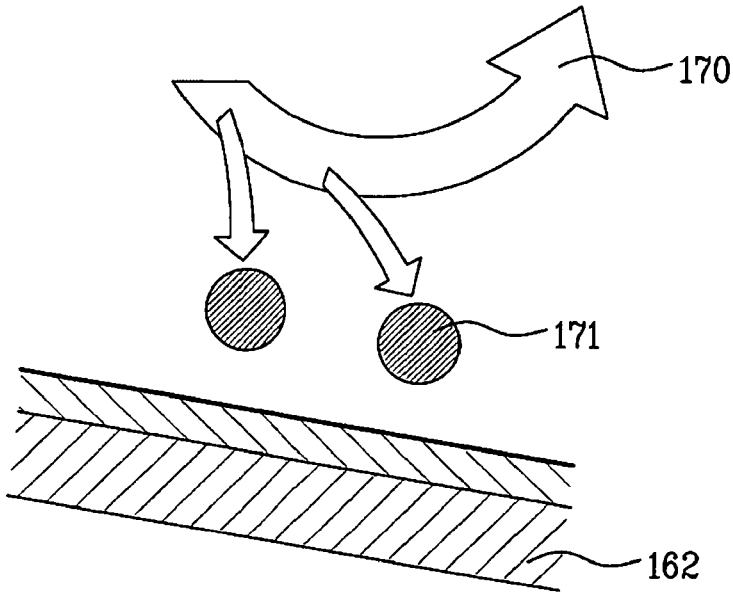
FIG. 4 is a view illustrating separation of oil drops from refrigerant in the oil separator for air conditioners according to the first preferred embodiment of the present invention.

After the refrigerant 170 slowly descends, while flowing along the inner circumferential surface of the shell 162, to the vicinity of the lower end of the refrigerant discharge pipe 166, the refrigerant 170 is sucked into the refrigerant discharge pipe 166. As a result, the flow direction of the refrigerant 170 is abruptly changed. At this time, the oil drops 171 contained in the refrigerant 170 are sufficiently grown, i.e., the size and the mass of the oil drops 171 contained in the refrigerant 170 are sufficiently increased, as shown in FIG. 4. Consequently, the oil drops 171 are separated from the refrigerant 170 being sucked into the refrigerant discharge pipe 166 due to centrifugal force. The oil drops 171 separated from the refrigerant 170 adhere to the inner circumferential surface of the shell 162 or fall onto the bottom surface of the shell 162.

The oil drops 171 which adhere to the inner circumferential surface of the shell 162 fall onto the bottom surface of the shell 162 due to gravity. In this way, the oil drops 171 gathered on the bottom surface of the shell 162 are supplied to the compressor through the oil collection pipe 168. When the refrigerant 170 flows laterally along the outer circumferential surface of the oil separating bar 165, the oil drops 171 contained in the refrigerant 170 collide with one another, and therefore, the size and the mass of the oil drops 171 are increased. As a result, the oil drops 171 can be easily separated from the refrigerant 170 by centrifugal force. Consequently, oil separating efficiency is improved.

When the air conditioner is in standby mode, the oil separator 160 is cooled. Consequently, when the operation of the air conditioner is initiated after the air conditioner is maintained in the standby mode, refrigerant introduced into the oil separator 160 is excessively condensed, since the oil separator 160 is in a cooled state. As a result, the liquid refrigerant is discharged together with the oil out of the oil separator 160. Consequently, the oil separating efficiency is greatly decreased.

Figure 5:
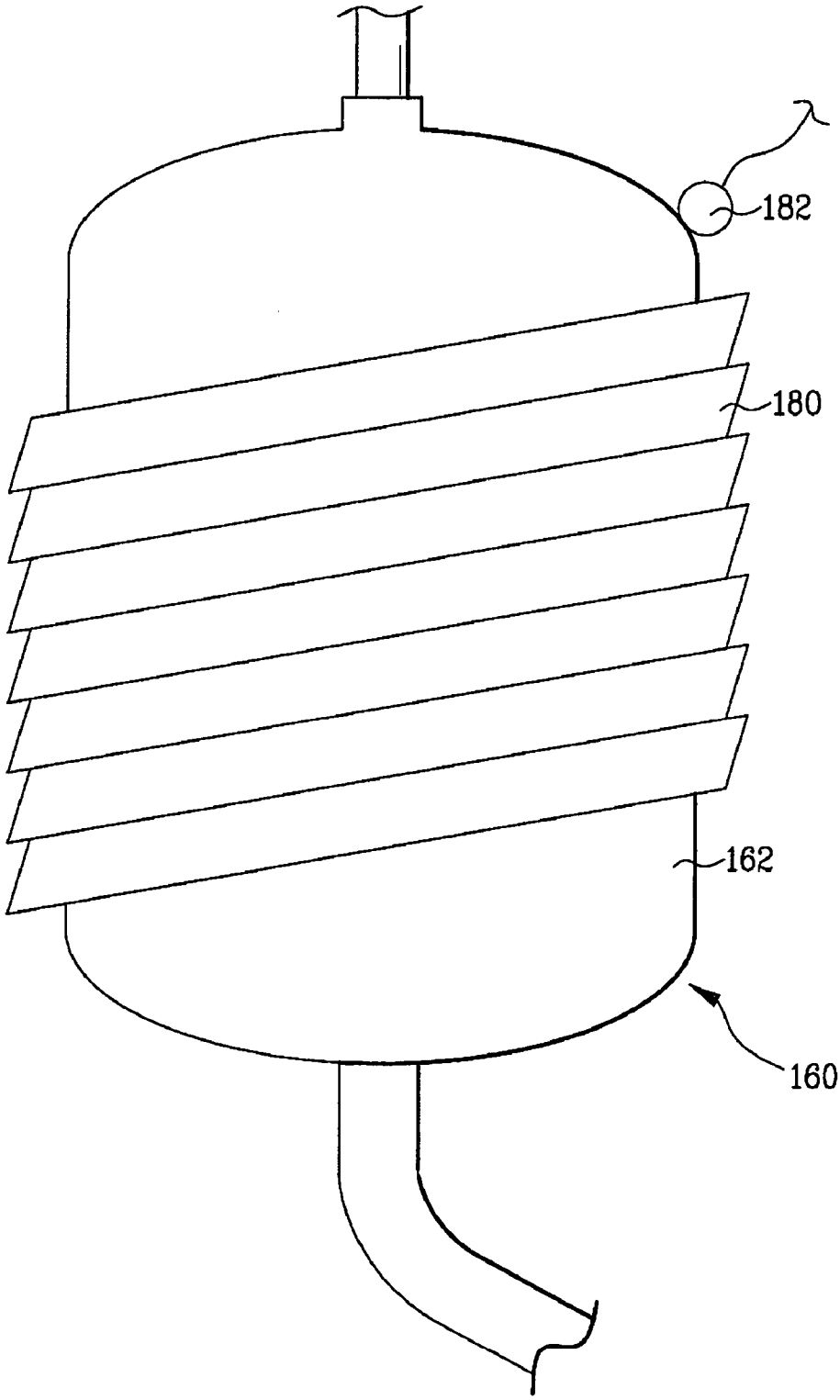
FIG. 5 is a side view illustrating heater of the oil separator for air conditioners according to the first preferred embodiment of the present invention.

For this reason, the oil separator 160 further comprises heater 180 for heating the shell 162 in accordance with the present invention. As shown in FIG. 5, the heater 180 is attached to the surface of the shell 162. Preferably, the heater 180 is an electric heater using electricity as a heating source, although the shell 162 may be heated by other heating sources, such as a gas turbine or an internal engine.

When the air conditioner is in the standby mode for a long period of time, the oil separator 160 is cooled. Consequently, the heater 180 serves to heat the shell 162, such that the oil separator 160 is maintained at predetermined temperature, when the air conditioner is in the standby mode. Preferably, the heater 180 heats the shell 162, such that the surface of the shell 162 is maintained at a temperature of 40 to 50° C.

Also preferably, a temperature sensor 182 is attached to the surface of the shell 162 for detecting the surface temperature of the shell 162. When the surface temperature of the shell 162 detected by the temperature sensor 182 is below a predetermined level, the shell 162 is heated by the heater 180. As a result, the shell 162 is maintained at the predetermined temperature.

Consequently, the oil separator 160 is maintained at the predetermined temperature when the operation of the air conditioner is initiated after the air conditioner is maintained in the standby mode, and therefore, the refrigerant introduced into the shell 162 is prevented from being excessively condensed. As a result, discharge of the liquid refrigerant together with the oil out of the shell 162 through the refrigerant discharge pipe 166 is effectively prevented.

Figure 6:
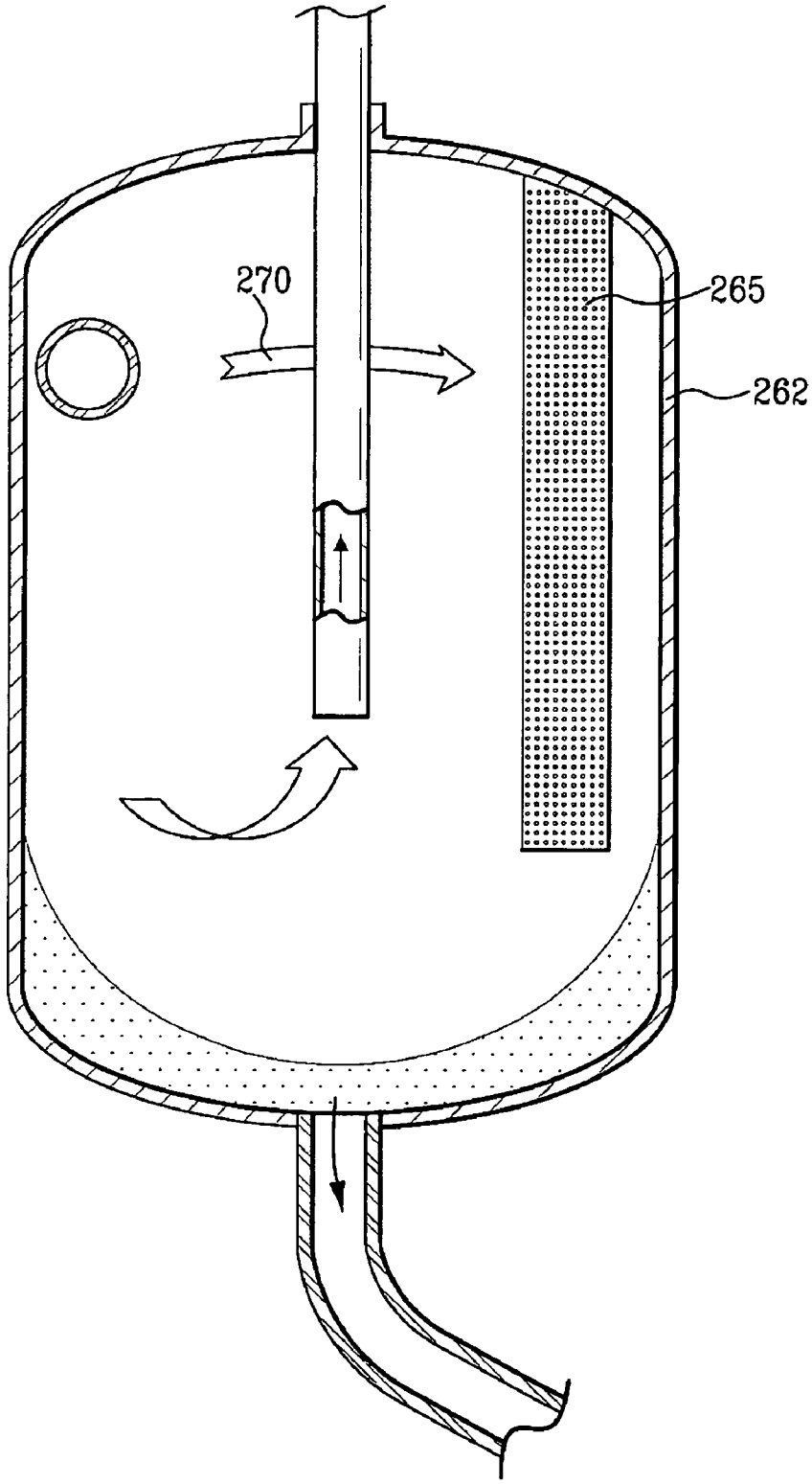
FIG. 6 is a longitudinal sectional view illustrating an oil separator for air conditioners according to a second preferred embodiment of the present invention.
Figure 7:
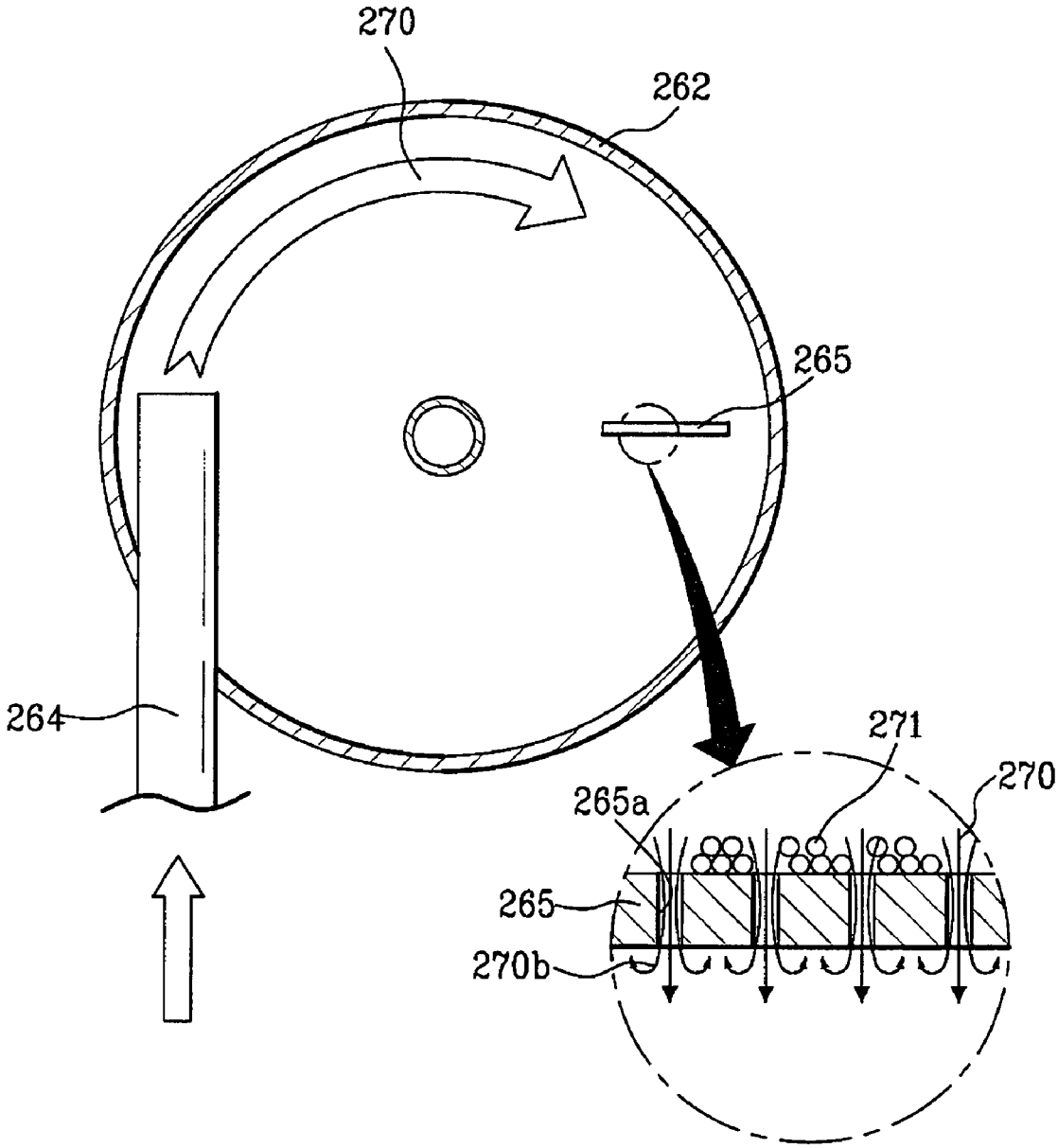
FIG. 7 is a cross-sectional view of the oil separator for air conditioners according to the second preferred embodiment of the present invention.
Figure 8:
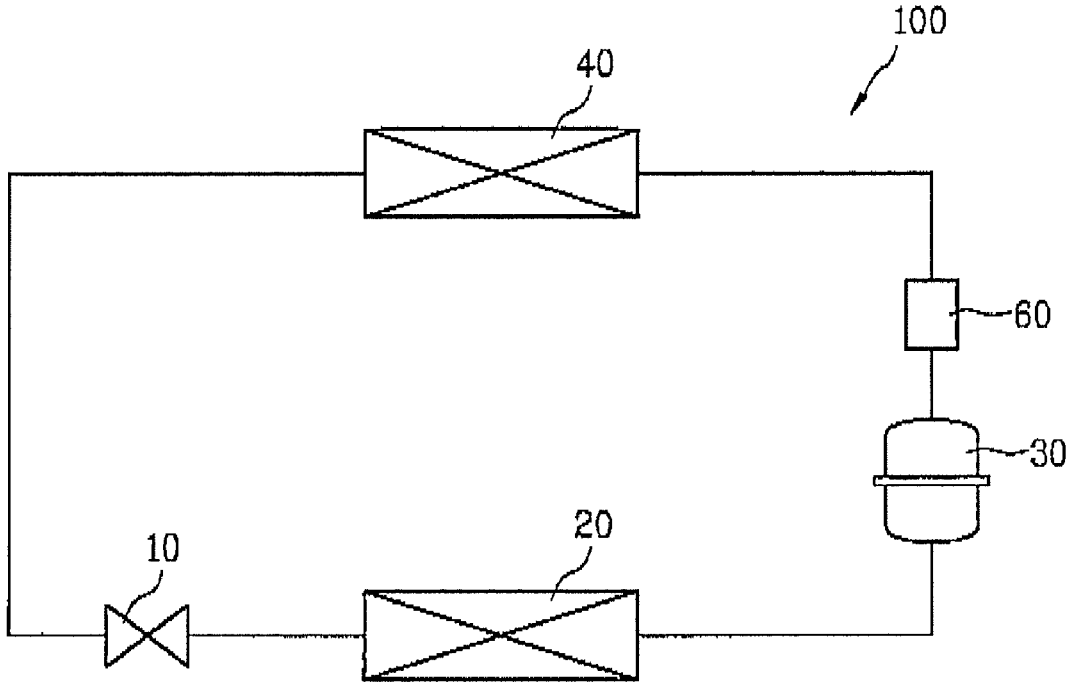
FIG. 8 PRIOR ART
FIG. 8 is a schematic view of an air conditioner according to the prior art.

In the oil separator for air conditioners according to the above-described first preferred embodiment of the present invention, the oil separating bar is characterized by the circular section. Alternatively, the oil separating bar may be porous, as shown in FIGS. 6 and 7. FIG. 6 is a longitudinal sectional view illustrating an oil separator for air conditioners according to a second preferred embodiment of the present invention, and FIG. 7 is a cross-sectional view of the oil separator for air conditioners according to the second preferred embodiment of the present invention.

As shown in FIG. 6, the oil separator for air conditioners according to the second preferred embodiment of the present invention is characterized by an oil separating bar 265. Preferably, the oil separating bar 265 is disposed in the longitudinal direction of a shell 262 while being spaced a predetermined distance from the inner circumferential surface of the shell 262, along which refrigerant 270 flows. The oil separating bar 265 has a plurality of micro holes 265*a* (see FIG. 7), through which the refrigerant 270, which is in a gaseous state, passes.

Consequently, the refrigerant 270 introduced into the shell 262 through a refrigerant introduction pipe 264 flows along the inner circumferential surface of the shell 262, and then passes through the holes 265*a* of the oil separating bar 265. When the refrigerant 270 passes through the holes 265*a* of the oil separating bar 265, some of oil drops 271 contained in the refrigerant 270 do not pass through the holes 265*a* of the oil separating bar 265, and collide with the surface of the oil separating bar 265. As a result, the oil drops 271 are combined with one another.

The above-described process is repetitively carried out, and therefore, the oil drops 271 are grown, i.e., the size and the mass of the oil drops 271 are increased. The grown oil drops 271 fall onto the bottom surface of the shell 262. Also, the gaseous refrigerant 270 flows in the shape of vortex after passing through the holes 265*a* of the oil separating bar 265. As a result, the oil drops 271 passing through the holes 265*a* of the oil separating bar 265 collide with one another, by which growth of the oil drops 271 is facilitated. Other components of the oil separator for air conditioners according to the second preferred embodiment of the present invention are identical in construction and operation to those of the first preferred embodiment of the present invention, and therefore, a detailed description thereof will not be given.

The oil separator for air conditioners according to the present invention has the following effects. First, the fine oil particles contained in the gaseous refrigerant collide with one another by the oil separating bar, and therefore, the oil particles are grown, i.e., the size and the mass of the oil particles are increased. Consequently, the oil drops are easily separated from the refrigerant by centrifugal force, and therefore, oil separating efficiency is improved.

Furthermore, the shell is maintained at the predetermined temperature by the heater when the air conditioner is in standby mode. As a result, the gaseous refrigerant is prevented from being excessively condensed in the shell when the operation of the air conditioner is initiated after the air conditioner is maintained in the standby mode. Consequently, oil is effectively prevented from being discharged out of the shell through the refrigerant discharge pipe.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An oil separator for air conditioners, comprising:

a shell having a cylindrical space defined therein;

a refrigerant introduction pipe for introducing refrigerant into the shell;

a refrigerant discharge pipe for discharging the refrigerant out of the shell; and an oil-drop growth accelerating member for accelerating growth of oil drops contained in the refrigerant flowing in the shell, wherein the oil-drop growth accelerating member is a bar-shaped member mounted in the shell, and wherein the oil-drop growth accelerating member is porous.

2. The oil separator as set forth in claim 1, wherein the oil-drop growth accelerating member accelerates growth of the oil drops by creating vortex flow in the refrigerant introduced into the shell.

3. The oil separator as set forth in claim 1, wherein the oil-drop growth accelerating member has a circular section.

4. The oil separator as set forth in claim 1, wherein the oil-drop growth accelerating member is disposed in the longitudinal direction of the shell.

5. The oil separator as set forth in claim 1, wherein the oil-drop growth accelerating member is spaced a predetermined distance from an inner circumferential surface of the shell.

6. The oil separator as set forth in claim 1, further comprising:

a heater for heating the shell.

7. The oil separator as set forth in claim 6, further comprising:

a temperature sensor for detecting the surface temperature of the shell.

8. The oil separator as set forth in claim 6, wherein the heater heats the shell when the air conditioner is in standby mode.

9. The oil separator as set forth in claim 6, wherein the heater heats the shell such that the surface of the shell is maintained at a temperature of 40 to 50° C.

10. An oil separator for air conditioners, comprising:

a shell having a cylindrical space defined therein;

a refrigerant introduction pipe for introducing refrigerant into the shell;

a refrigerant discharge pipe for discharging the refrigerant out of the shell; and an oil separating member for separating oil drops from the refrigerant by inducing collision of the oil drops contained in the refrigerant flowing in the shell, wherein the oil separating member is a bar-shaped member mounted in the shell, and wherein the oil separating member is porous.

11. The oil separator as set forth in claim 10, wherein the oil separating member changes flow speed and flow direction of the refrigerant flowing in the shell to induce collision of the oil drops such that the size of the oil drops is increased.

12. The oil separator as set forth in claim 10, wherein the oil separating member is mounted in the shell in the longitudinal direction of the shell.

13. The oil separator as set forth in claim 10, wherein the oil separating member is spaced a predetermined distance from an inner circumferential surface of the shell.

14. The oil separator as set forth in claim 10, wherein the oil separating member has a circular section.

15. The oil separator as set forth in claim 10, further comprising:

a heater for heating the shell.

16. The oil separator as set forth in claim 15, further comprising:

a temperature sensor for detecting the surface temperature of the shell.

17. The oil separator as set forth in claim 15, wherein the heater heats the shell when the air conditioner is in standby mode.

18. The oil separator as set forth in claim 15, wherein the heater heats the shell such that the surface of the shell is maintained at a temperature of 40 to 50° C.

* * * * *